US008449039B2

(12) United States Patent
Hall

(10) Patent No.: US 8,449,039 B2
(45) Date of Patent: May 28, 2013

(54) PICK ASSEMBLY WITH INTEGRATED PISTON

(76) Inventor: David R. Hall, Provo, UT (US)

( * ) Notice: Subject to any disclaimer, the term of this patent is extended or adjusted under 35 U.S.C. 154(b) by 367 days.

(21) Appl. No.: 12/856,959

(22) Filed: Aug. 16, 2010

(65) Prior Publication Data

US 2012/0038203 A1 Feb. 16, 2012

(51) Int. Cl.

| | |
|---|---|
| ***E21C 35/19*** | (2006.01) |
| ***E21C 35/18*** | (2006.01) |
| ***B25D 17/02*** | (2006.01) |
| ***E21C 35/193*** | (2006.01) |
| *E02F 9/28* | (2006.01) |

(52) U.S. Cl.

CPC ..... *E21C 35/19* (2013.01); *B25D 17/02* (2013.01); *E21C 35/1933* (2013.01); *E02F 9/2816* (2013.01)

USPC ..... 299/85.2; 299/80.1; 299/100

(58) Field of Classification Search

CPC ..... E21C 35/18; E21C 35/183; E21C 35/19

USPC ..... 299/1.2, 1.5, 10, 32, 37.4, 80.1, 85.1, 299/106, 102, 104, 105, 107, 108

See application file for complete search history.

(56) References Cited

U.S. PATENT DOCUMENTS

| | | | | |
|---|---|---|---|---|
| 2,124,438 | A | | 7/1938 | Struk |
| 3,254,392 | A | | 6/1966 | Novkov |
| 3,830,321 | A | | 8/1974 | McKenry |
| 4,098,362 | A | | 7/1978 | Bonnice |
| 4,109,737 | A | | 8/1978 | Bovenkerk |
| 4,156,329 | A | | 5/1979 | Daniels |
| 4,175,886 | A | | 11/1979 | Moench |
| 4,189,183 | A | * | 2/1980 | Borowski ..... 299/1.6 |
| 4,199,035 | A | | 4/1980 | Thompson |
| 4,439,250 | A | | 3/1984 | Acharya |
| 4,465,221 | A | | 8/1984 | Schmidt |
| 4,555,143 | A | * | 11/1985 | Wrulich et al. ..... 299/81.2 |
| 4,664,450 | A | * | 5/1987 | Radford ..... 299/81.2 |
| 4,776,862 | A | | 10/1988 | Wiand |
| 4,880,154 | A | | 11/1989 | Tank |
| 4,932,723 | A | | 6/1990 | Mills |
| 4,940,288 | A | | 7/1990 | Stiffler |
| 4,951,762 | A | | 8/1990 | Lundell |

(Continued)

FOREIGN PATENT DOCUMENTS

| | | | |
|---|---|---|---|
| EP | 0825003 A2 | * | 2/1998 |
| WO | WO 2011/101612 | * | 8/2011 |

*Primary Examiner* — David Bagnell
*Assistant Examiner* — John Williams
(74) *Attorney, Agent, or Firm* — Philip W. Townsend, III

(57) ABSTRACT

In one embodiment a pick assembly comprises a rotatable drum comprising at least one block disposed on a circumferential surface of the drum. The at least one block comprises a cavity comprising a cylinder. A pick comprises a working end and an opposing base end wherein the base end is disposed within the cavity and comprises a piston that is slidably retained within the cylinder. In a second embodiment a pick assembly comprises a rotatable drum comprising at least one block disposed on a circumferential surface of the drum. The rotatable drum comprises a cavity comprising a cylinder. The at least one block comprises a first end and an opposing second end wherein the second end is disposed within the cavity. A pick comprising a working end is rigidly secured to the first end of the at least one block and the second end comprises a piston slidably retained within the cylinder.

18 Claims, 11 Drawing Sheets

U.S. PATENT DOCUMENTS

| | | | | |
|---|---|---|---|---|
| 5,074,063 | A | | 12/1991 | Vannette |
| 5,112,165 | A | | 5/1992 | Hedlund |
| 5,141,289 | A | | 8/1992 | Stiffler |
| 5,186,892 | A | | 2/1993 | Pope |
| 5,219,380 | A | | 6/1993 | Young |
| 5,392,540 | A | | 2/1995 | Cooper |
| RE35,088 | E | | 11/1995 | Gilbert |
| 5,490,339 | A | | 2/1996 | Accettola |
| 5,607,205 | A | * | 3/1997 | Burdick et al. ..... 299/1.5 |
| 5,738,698 | A | | 4/1998 | Kapoor |
| 5,837,071 | A | | 11/1998 | Andersson |
| 5,934,542 | A | | 8/1999 | Nakamura |
| 5,935,718 | A | | 8/1999 | Demo |
| 5,944,129 | A | | 8/1999 | Jensen |
| 6,051,079 | A | | 4/2000 | Andersson |
| 6,065,552 | A | | 5/2000 | Scott |
| 6,193,770 | B1 | | 2/2001 | Sung |
| 6,199,956 | B1 | | 3/2001 | Kammerer |
| 6,341,823 | B1 | | 1/2002 | Sollami |
| 6,382,733 | B1 | | 5/2002 | Parrott |
| 6,457,267 | B1 | | 10/2002 | Porter |
| 6,543,963 | B2 | | 4/2003 | Bruso |
| 6,692,083 | B2 | | 2/2004 | Latham |
| 6,779,948 | B2 | | 8/2004 | Bruso |
| 6,786,557 | B2 | | 9/2004 | Montgomery, Jr. |
| 6,824,225 | B2 | | 11/2004 | Stiffler |
| 6,851,758 | B2 | | 2/2005 | Beach |
| 6,854,201 | B1 | | 2/2005 | Hunter |
| 6,854,810 | B2 | | 2/2005 | Montgomery, Jr. |
| 6,861,137 | B2 | | 3/2005 | Griffin et al. |
| 6,889,890 | B2 | | 5/2005 | Yamazaki |
| 7,150,131 | B2 | | 12/2006 | Barker |
| 2002/0175555 | A1 | | 11/2002 | Mercier |
| 2003/0140350 | A1 | | 7/2003 | Watkins et al. |
| 2003/0234280 | A1 | | 12/2003 | Cadden |
| 2005/0159840 | A1 | | 7/2005 | Lin |
| 2005/0173966 | A1 | | 8/2005 | Mouthaan |
| 2008/0284235 | A1 | | 11/2008 | Hall |

* cited by examiner

PICK ASSEMBLY WITH INTEGRATED PISTON

BACKGROUND OF THE INVENTION

The present invention relates to the field of formation degradation and more specifically pavement milling. A milling machine may comprise a driving mechanism populated with a plurality of degradation assemblies, typically picks or cutters, which may degrade natural or man-made formations such as pavement, concrete, or asphalt when the driving mechanism is rotated while in contact with the formation. During normal milling operation, the degradation assemblies are often damaged due to coming into contact with hard materials buried underneath or located on the surface of the formation. The prior art discloses milling assemblies for improving the service life of said degradation assemblies.

One such milling assembly is disclosed in U.S. Pat. Pub. No. 2008/0284235 to Hall et al., which is herein incorporated by reference for all that it contains. Hall et al. discloses an apparatus for degrading natural and man-made formations including a pick with an axially spring loaded pick comprising a central axis and being attached to a holder secured to a driving mechanism. The pick comprising a steel body with an axial shank disposed within a bore of the holder. A spring mechanism may be built into the holder which allows the tip to engage the formation and then recoil away from the formation lessening drag that would otherwise occur on the tip. The recoiling effect is believed to reduce wear caused from the drag. The recoiling effect is also believed to degrade the formation in larger chunks than dragging the tip against the formation surface. The spring mechanism may comprise a coil spring, a compression spring, a tension spring, Belleville spring, wave spring, elastomeric material, gas spring, or combinations thereof. The pick may also comprise an axial shank which is press fit into the holder. The shank is secured within a holder which is secured to the driving mechanism.

Another such milling assembly is disclosed in U.S. Pat. No. 4,175,886 to Moench et al., which is herein incorporated by reference for all that it contains. Moench et al. discloses an asphalt cutting apparatus for breaking up and windowing old asphaltic pavement on a roadway or the like including the pavement adjacent to a curb or gutter. A plurality of laterally spaced, sharpened cutter discs are freely rotatably mounted on a support carriage. The support carriage is attached to a frame pivotally coupled at a forward pivot to a prime mover such as a truck or similar vehicle for movement along the asphalt surface. As the cutter discs are moved along the asphalt surface a hydraulic clamp cylinder provides a vertical movement about the forward pivot to vary the depth of cut and also maintains a downward pressure on the cutter discs and forces the discs to roll through and cut up the asphalt.

The construction and mounting of the support carriage is such that the discs are adjustably movable laterally axially along a horizontal axis for selective positioning adjacent to a curb or gutter and are further adjustably movable about a pivot to slope laterally outwardly and downwardly so that the discs are positioned at different cutting depths relative to one another for cutting an asphalt surface that is sloped for drainage purposes.

BRIEF SUMMARY OF THE INVENTION

In one aspect of the present invention a pick assembly comprises a rotatable drum comprising at least one block disposed on a circumferential surface of the drum wherein the at least one block comprises a cavity comprising a cylinder, and a pick comprising a working end and an opposing base end wherein the base end is disposed within the cavity and comprises a piston that is slidably retained within the cylinder.

The piston may define first and second pressure chambers within the cylinder wherein a first fluid channel may be in fluid communication with the first pressure chamber and a second fluid channel may be in fluid communication with the second pressure chamber. At least one valve may alternately connect the first and second fluid channels to a pressurized fluid channel and a relief fluid channel. The pick may comprise an expanded axial position when the pressurized fluid channel is in fluid communication with the second fluid channel and a retracted axial position when the pressurized fluid channel is in fluid communication with the first fluid channel.

In another embodiment, the first pressure chamber may comprise a first surface and the second pressure chamber may comprise a second surface wherein the second surface is substantially greater than the first surface. The first fluid channel may be connected to the pressurized fluid channel while the at least one valve alternately connects the second fluid channel to the pressurized fluid channel or the relief fluid channel. The pick may expand when the second fluid channel is connected to the pressurized fluid channel due to the difference in size between the first surface and the second surface.

The at least one valve may be controlled by a mechanical actuator comprising a linear solenoid, a rotary solenoid, or a hydraulic motor. The mechanical actuator may be in communication with an electronic circuit which my read data, redirect power, and send information about the position of the at least one valve through an armored coaxial wire.

The rotatable drum may comprise a plurality of blocks disposed on a circumferential surface of the drum. Each block may be connected to a unique electronic circuit and a single armored coaxial wire may connect all unique electronic circuits together.

In another embodiment of the present invention a pick assembly may comprise a rotatable drum comprising a cavity within the drum, the cavity comprising a cylinder. At least one block may comprise a first end and an opposing second end wherein the second end is disposed within the cavity and comprises a piston that is slidably retained within the cylinder. A pick comprising a working end is rigidly secured to the first end of the at least one block.

In another embodiment of the present invention a method of milling a surface with a pick assembly comprises sending an electrical signal through a single armored coaxial wire to a piston cylinder device instructing the piston cylinder device to expand or retract. The method may further comprise sending an electrical signal through the single armored coaxial wire to independent piston cylinder devices instructing the piston cylinder devices to expand or retract independently. Each piston cylinder device may comprise a unique identifier signal wherein the piston cylinder device recognizes the identifier signal when it is sent through the single armored coaxial wire.

The method may further comprise providing an object detection system, passing the object detection system over a surface, and detecting at least one object on or beneath the surface with the object detection system. An electrical signal may be sent comprising information about the detected at least one object. The rotatable drum may pass over the surface and the piston cylinder device may retract to avoid making contact with the detected at least one object. The object detection system may comprise ground penetrating radar or a metal detector. The step of retracting the piston cylinder device to avoid making contact with the detected at least one object may comprise retracting the piston cylinder device automatically or manually.

The method may further comprise passing the rotatable drum over a surface, removing a portion of the surface with the at least one pick, and varying a volume of the portion removed by expanding or retracting the piston cylinder device.

An electrical signal may be sent comprising stored information about at least one object on or beneath a surface. The rotatable drum may pass over the surface and the piston cylinder device may retract to avoid making contact with the at least one object.

DETAILED DESCRIPTION OF THE INVENTION AND THE PREFERRED EMBODIMENT

Figure 1:
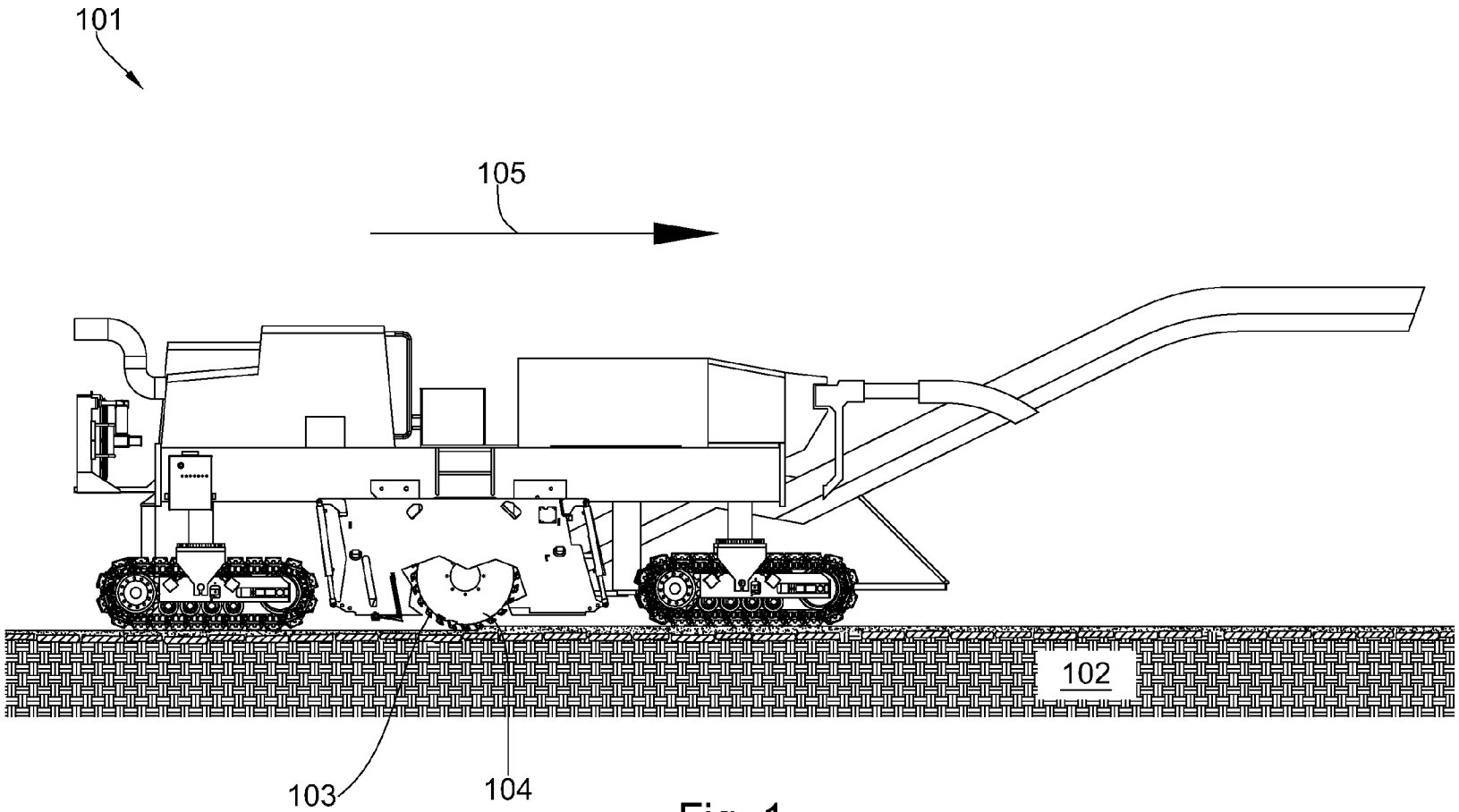
FIG. 1 is an orthogonal view of an embodiment of a pavement milling machine.

Referring now to the figures, FIG. 1 discloses an embodiment of a milling machine 101. The milling machine 101, also known as a cold planer, may be used to degrade natural or man-made formations 102 such as pavement, concrete or asphalt prior to placement of a new layer. The milling machine 101 may comprise a plurality of degradation assemblies 103 attached to a rotatable drum 104. The arrow 105 shows the machine's direction of travel.

Figure 2:
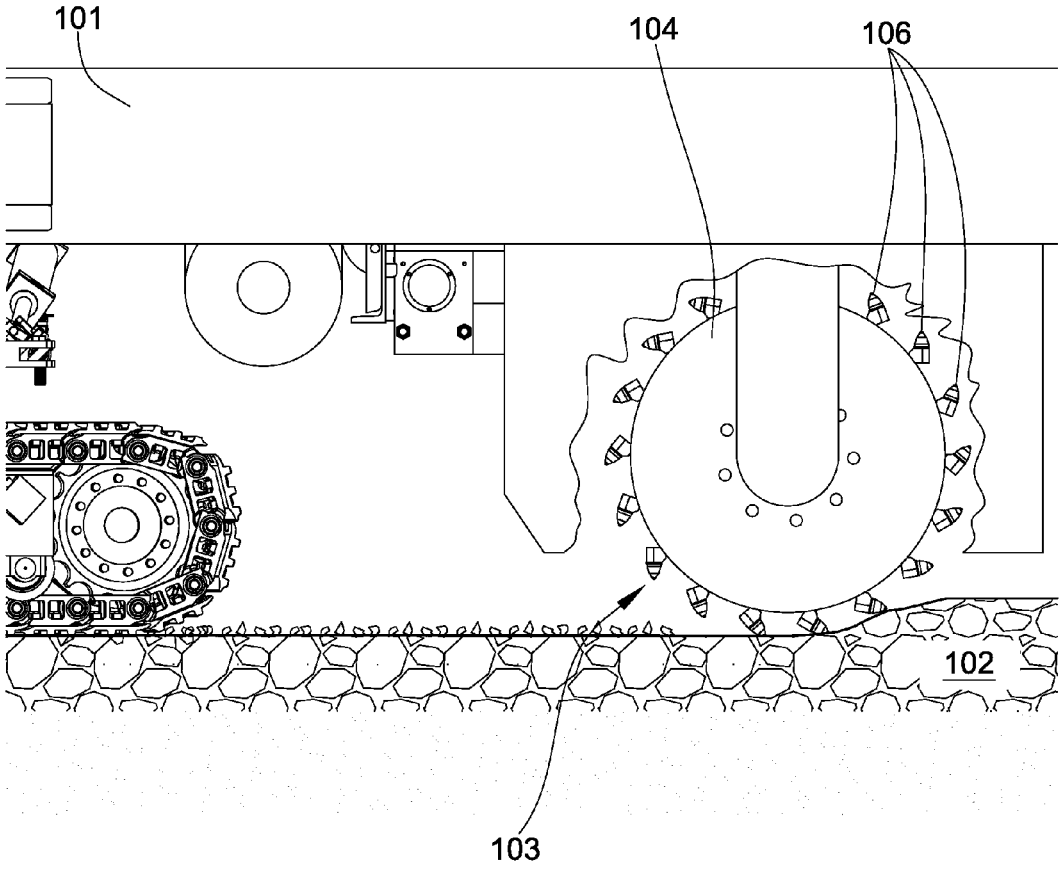
FIG. 2 is an orthogonal view of an embodiment of a rotatable drum attached to a pavement milling machine.

FIG. 2 discloses an embodiment of the rotatable drum 104 attached to the underside of the pavement milling machine 101 and comprising a plurality of degradation assemblies 103. In this embodiment, the plurality of degradation assemblies 103 comprise pick assemblies 106. The pick assemblies 106 may be attached to the rotatable drum 104 such that the pick assemblies 106 are brought into engagement with the formation 102.

Figure 3:
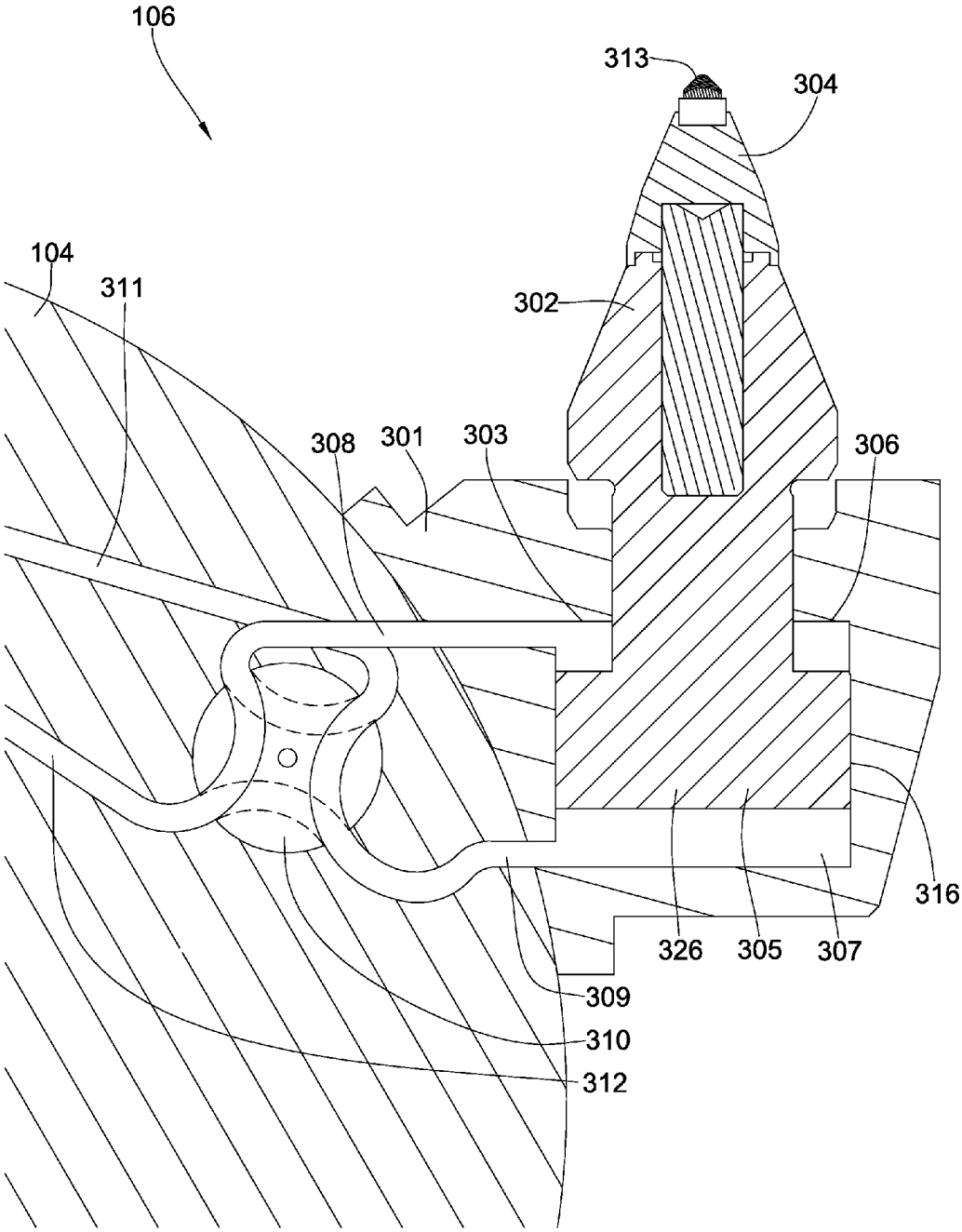
FIG. 3 is a cross-sectional view of an embodiment of a pick assembly.

FIG. 3 discloses an embodiment of a pick assembly 106 comprising a rotatable drum 104, at least one block 301, and a pick 302. The at least one block 301 may be disposed on a circumferential surface of the drum 104 and may comprise a cavity 303 comprising a cylinder 316. The pick 302 may comprise a working end 304 and an opposing base end 305 wherein the base end 305 is disposed within the cavity 303 of the at least one block 301 and may comprise a piston 326 that is slidable retained within the cylinder 303. The working end 304 may comprise a super hard tip 313 designed for high-impact resistance and long life while milling a formation (not shown). The super hard tip 313 may comprise a material selected from the group consisting of tungsten carbide, steel, diamond, silicon carbide, cubic boron nitride and combinations thereof. A first pressure chamber 306 and a second pressure chamber 307 may be defined by the piston 326 within the cylinder 316. A first fluid channel 308 may be in fluid communication with the first pressure chamber 306 and a second fluid channel 309 may be in fluid communication with the second pressure chamber 307. At least one valve 310 may alternately connect the first fluid channel 308 and the second fluid channel 309 to a pressurized fluid channel 311 and a relief fluid channel 312.

Figure 4A:
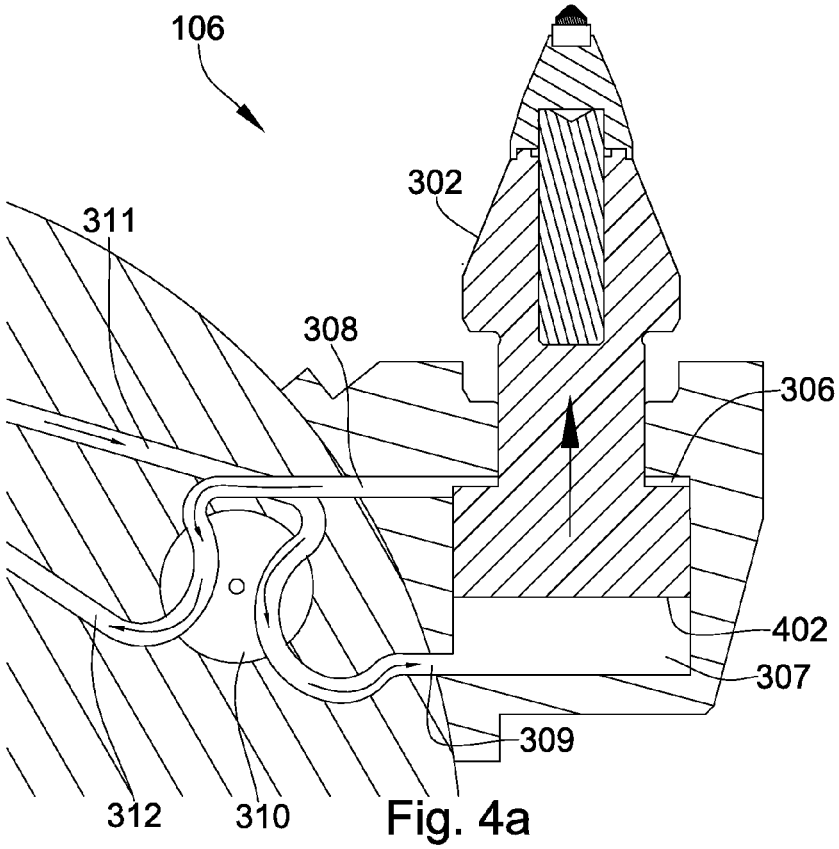
FIG. 4*a* is a cross-sectional view of an embodiment of a pick assembly.

FIG. 4*a* discloses an embodiment of a pick assembly 106 wherein the pick 302 is in an expanded axial position. In this embodiment, the at least one valve 310 connects the pressurized fluid channel 311 to the second fluid channel 309 and the relief fluid channel 312 to the first fluid channel 308. When the pressurized fluid channel 311 is connected to the second fluid channel 309, fluid may flow into the second pressure chamber 307 and apply pressure to a second surface 402 forcing the pick 302 to expand axially. Any fluid in the first pressure chamber 306 may exit through the first fluid channel 308 and subsequently the relief fluid channel 312.

Figure 4B:
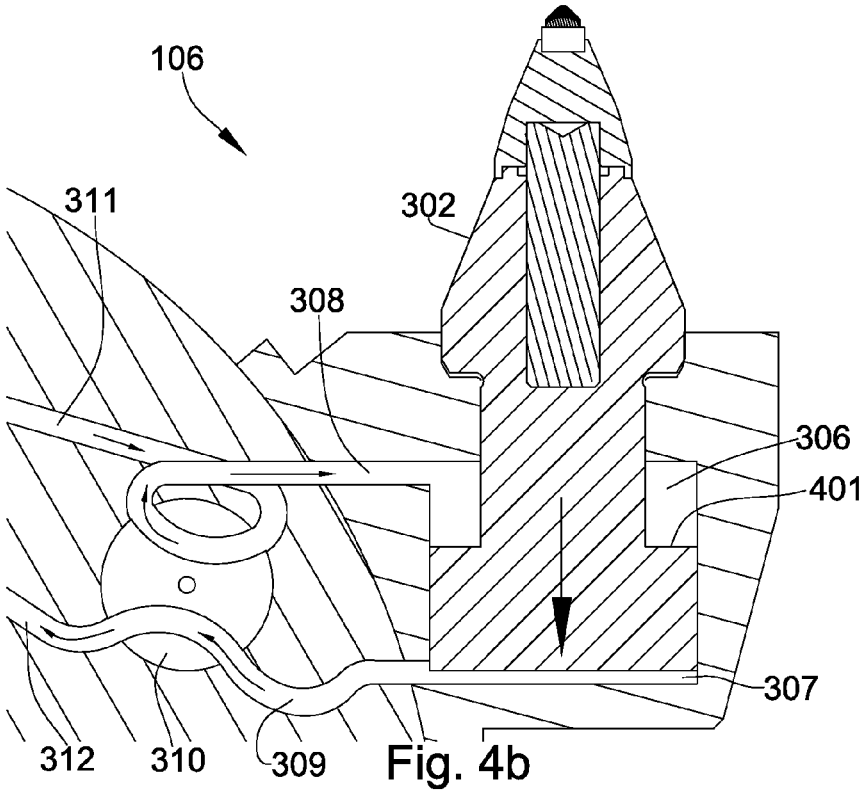
FIG. 4*b* is a cross-sectional view of another embodiment of a pick assembly.

FIG. 4*b* discloses an embodiment of a pick assembly 106 wherein the pick 302 is in a retracted axial position. In this embodiment, the at least one valve 310 connects the pressurized fluid channel 311 to the first fluid channel 308 and the relief fluid channel 312 to the second fluid channel 309. When the pressurized fluid channel 311 is connected to the first fluid channel 308, fluid may flow into the first pressure chamber 306 and apply pressure to a first surface 401 forcing the pick 302 to retract axially. Any fluid in the second pressure chamber 307 may exit through the second fluid channel 309 and subsequently the relief fluid channel 312.

Figure 5:
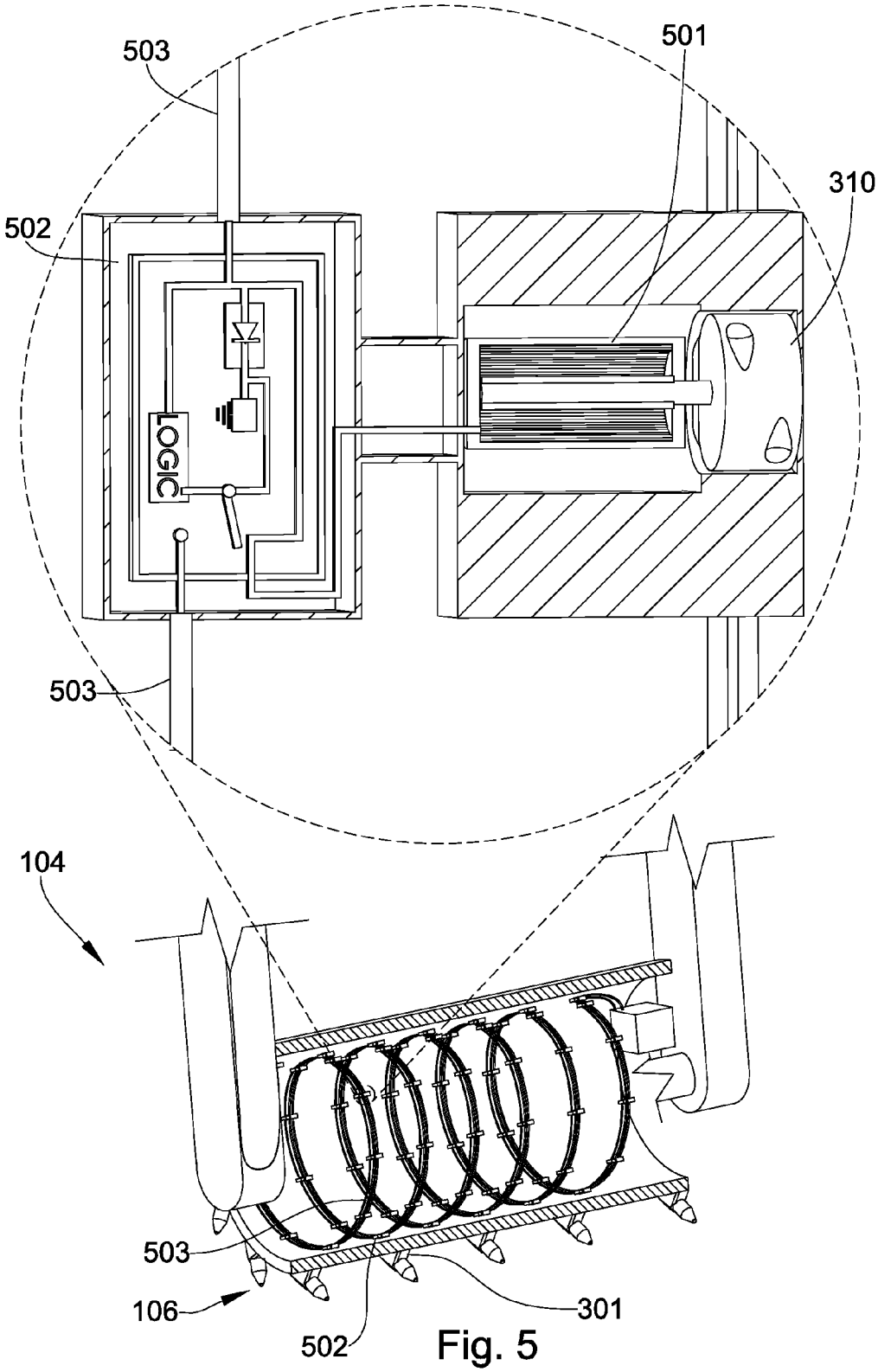
FIG. 5 is a cross-sectional view of an embodiment of a rotatable drum.

FIG. 5 discloses a cross-sectional view of an embodiment of a rotatable drum 104 comprising a plurality of pick assemblies 106. Also disclosed is a magnified view of embodiments of the at least one valve 310, a mechanical actuator 501, and an electronic circuit 502. Each pick assembly 106 may comprise a block 301 disposed on a circumferential surface of the drum 104 and connected to a unique electronic circuit 502. A single armored coaxial wire 503 may be disposed in the drum 104 and may connect all electronic circuits 502 together. Data and power may be sent through the armored coaxial wire 503 to each electronic circuit 502.

The at least one valve 310 may be controlled by a mechanical actuator 501 which may comprise a linear solenoid, a rotary solenoid, or a hydraulic motor. The mechanical actuator 501 may be in communication with the electronic circuit 502. The electronic circuit 502 may read data and redirect power from the armored coaxial wire 503 to the mechanical actuator 501. The electronic circuit 502 may also send information about the position of the at least one valve 310 through the armored coaxial wire 503.

Figure 6:
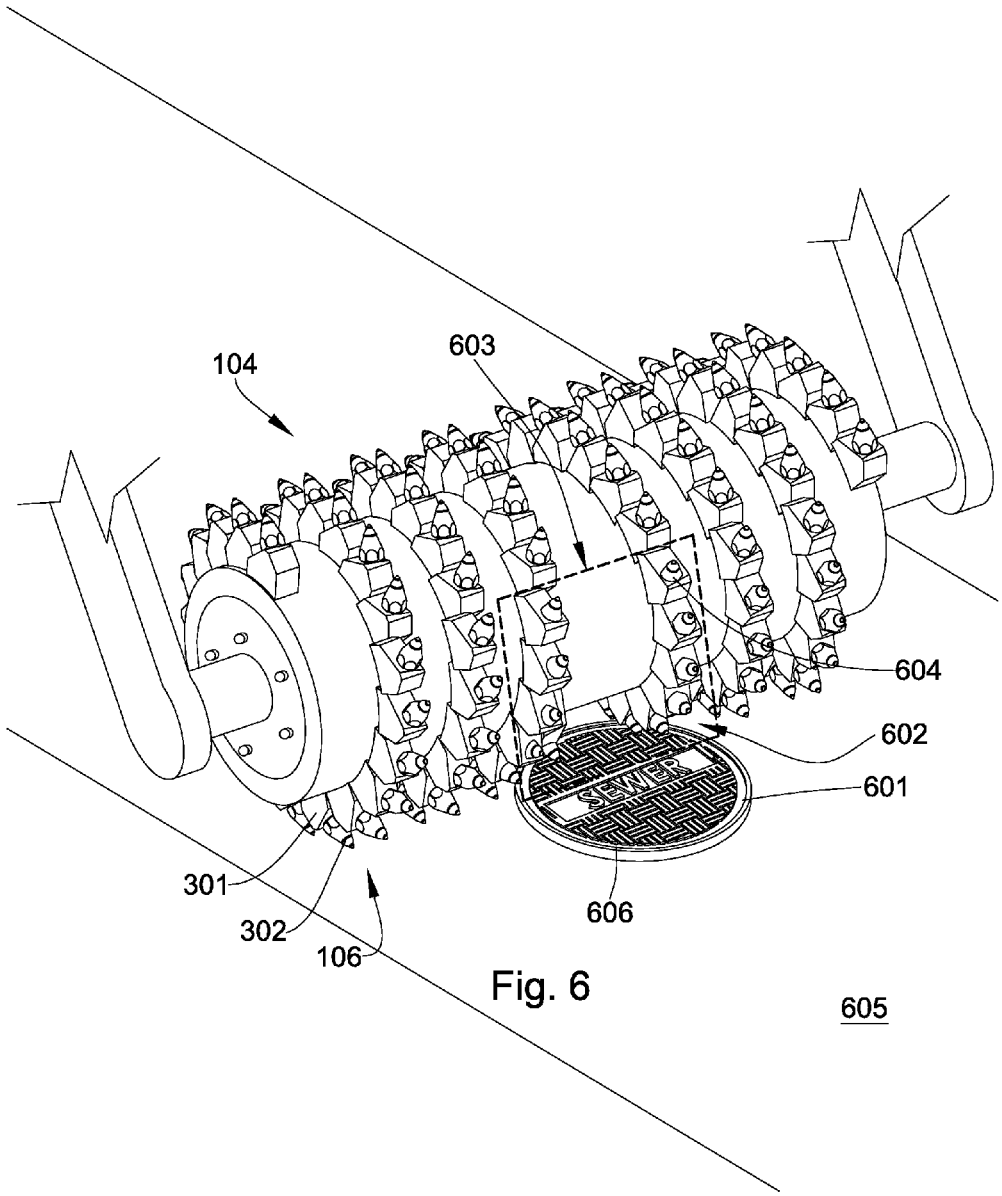
FIG. 6 is a perspective view of an embodiment of a rotatable drum.

FIG. 6 discloses a perspective view of an embodiment of a rotatable drum 104. The rotatable drum 104 may comprise a plurality of pick assemblies 106 wherein each pick assembly 106 may comprise at least one block 301 disposed on a circumferential surface of the drum 104, one pick 302 disposed within each block 301, and a piston cylinder device within each pick 302 capable of expanding or retracting each pick 302. During normal milling operations, hard materials 601, such as a man-hole cover 606, may be buried underneath or located on the surface of a formation 605 and may damage the pick assemblies 106. When the location of such a hard material 601 is known, an electrical signal may be sent through the armored coaxial wire (not shown) to the electronic circuit (not shown) instructing the piston cylinder devices to expand or retract. Each piston cylinder device may expand or retract independently of other piston cylinder devices. The electrical signal sent though the armored coaxial wire may instruct specific pick assemblies 106 to expand or retract to accomplish different functions. In the embodiment shown, pick assemblies 602 inside an area 603 each comprise a pick 604 in a retracted axial position to avoid contacting a man-hole cover 606. After each pick 604 has passed over the man-hole cover 606, another electrical signal may be sent instructing each pick 604 to expand thus engaging the formation 605.

Figure 7:
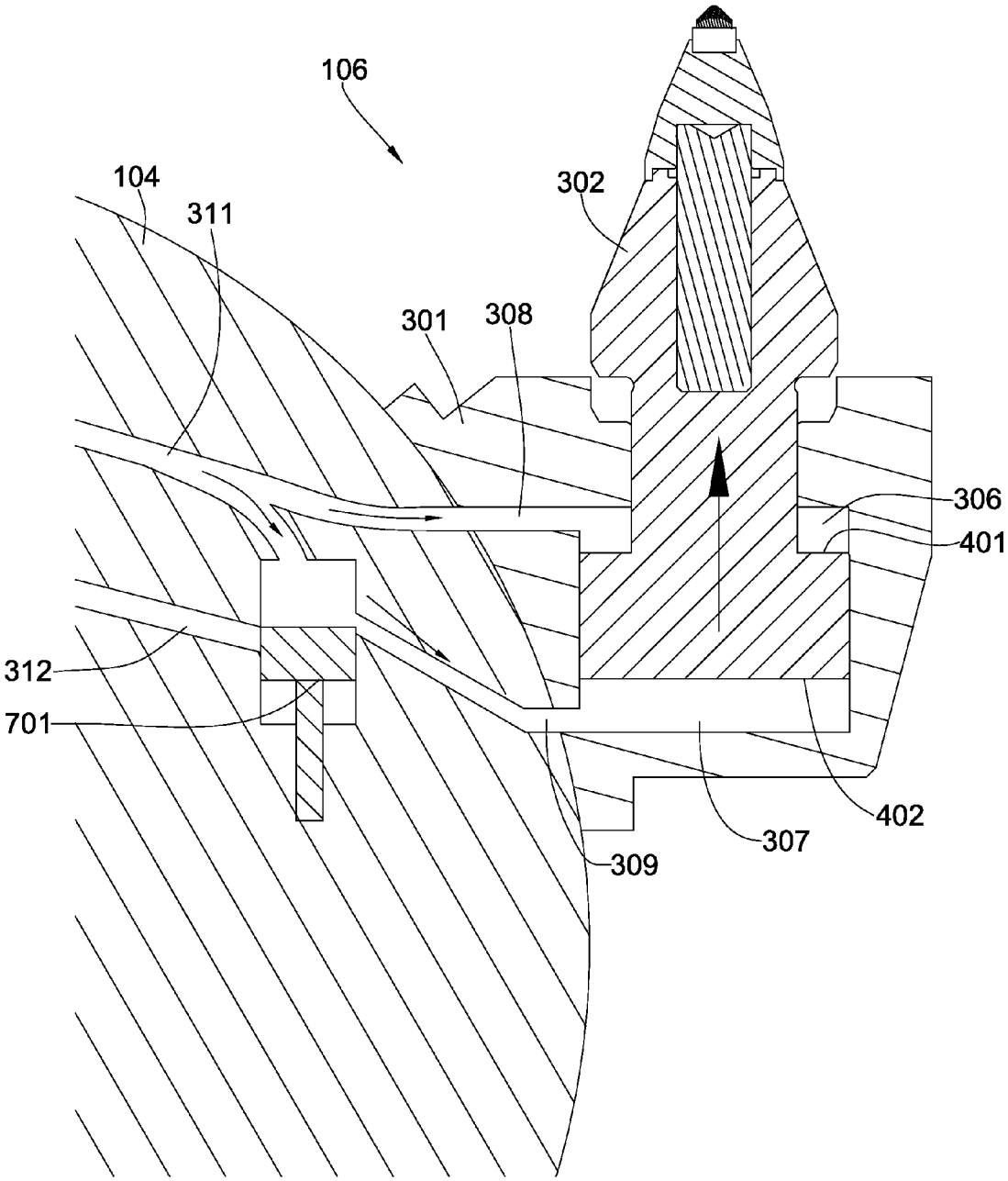
FIG. 7 is a cross-sectional view of an embodiment of a pick assembly.

FIG. 7 discloses another embodiment of the pick assembly 106 comprising a rotatable drum 104, at least one block 301, and a pick 302. The second surface 402 disposed in the second pressure chamber 307 may comprise a surface area substantially greater than a surface area of the first surface 401 disposed in the first pressure chamber 306. At least one valve 701 may alternately connect the second fluid channel 309 to the pressurized fluid channel 311 and the relief fluid channel 312 while the first fluid channel 308 may be in constant fluid communication with the pressurized fluid channel 311. When the at least one valve 701 connects the second fluid channel 309 with the pressurized fluid channel 311, the pressure in the second pressure chamber 307 may expand the pick 302. Although both the first fluid channel 308 and the second fluid channel 309 may be in fluid communication with the pressurized fluid channel 311, the pick 302 may expand due to the difference in surface area between the first surface 401 and second surface 402.

It is believed that because the second surface 402 may be substantially greater than the first surface 401, more force may be applied to the second surface 402. may be substantially greater than the first surface 401, more pressure may be applied to the second surface 402.

Figure 8:
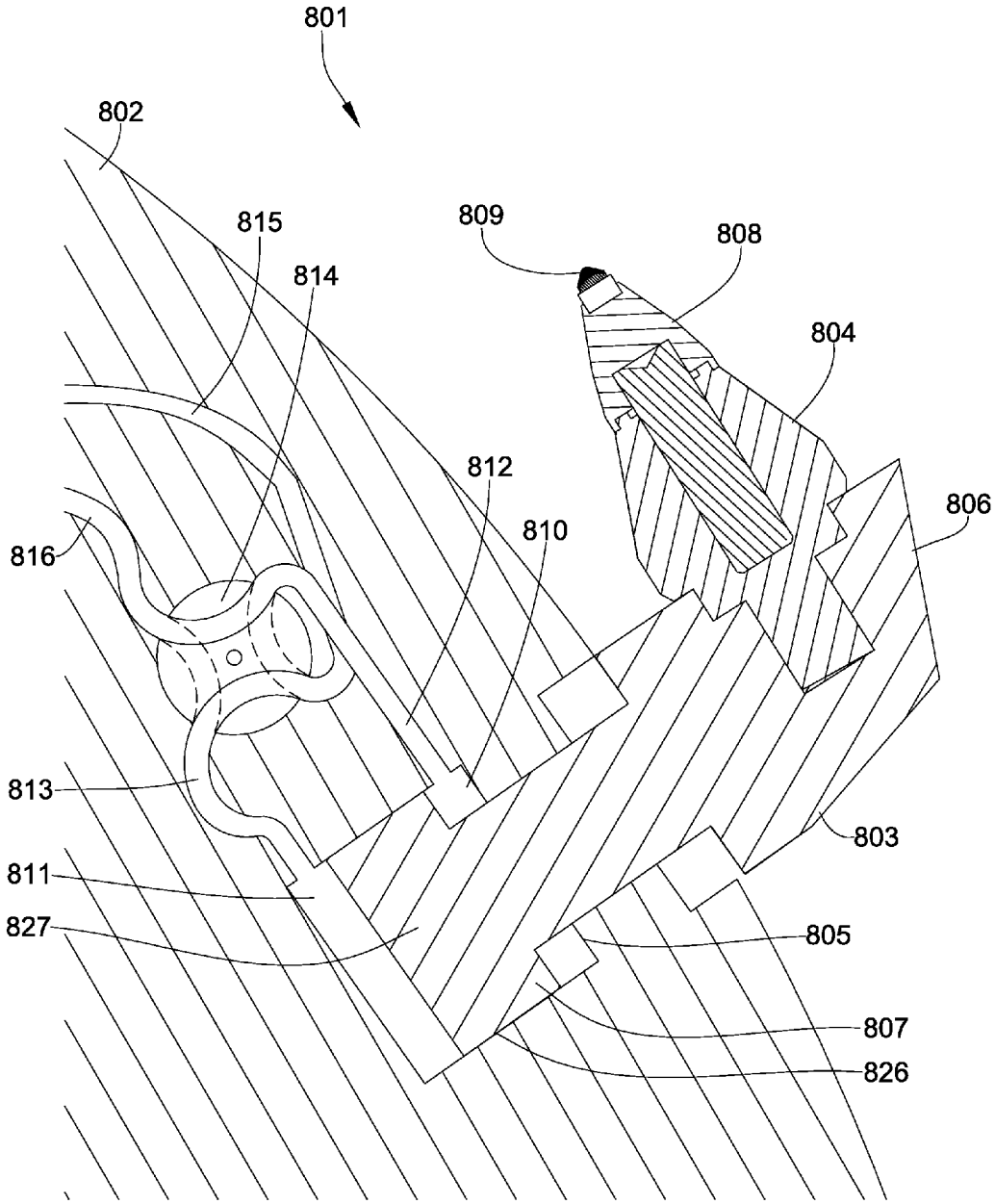
FIG. 8 is a cross-sectional view of an embodiment of a pick assembly.

FIG. 8 discloses an embodiment of a pick assembly 801 comprising a rotatable drum 802, at least one block 803, and a pick 804. The drum 802 may comprise a cavity 805 comprising a cylinder 826. The at least one block 803 may be disposed on a circumferential surface of the drum 802 and may comprise a first end 806 and an opposing second end 807. The second end 807 may be disposed within the cavity 805 of the drum 802 and may comprise a piston 827 that is slidably retained within the cylinder 826. The pick 804 may comprise a working end 808 comprising a super hard tip 809 and may be rigidly secured to the first end 806 of the at least one block 803. A first pressure chamber 810 and a second pressure chamber 811 may be defined by the piston 827 within the cylinder 826. A first fluid channel 812 may be in fluid communication with the first pressure chamber 810 and a second fluid channel 813 may be in fluid communication with the second pressure chamber 811. At least one valve 814 may alternately connect the first fluid channel 812 and the second fluid channel 813 to a pressurized fluid channel 815 and a relief fluid channel 816. The at least one block 803 may comprise an expanded or retracted position depending on the position of the at least one valve 814 and connecting the first and second fluid channels 812, 813 with the pressurized and relief fluid channels 815, 816. It is believed that by retracting the at least one block 803, the pick 804 may avoid contacting hard materials buried underneath or located on the surface of a formation (not shown).

Figure 9:
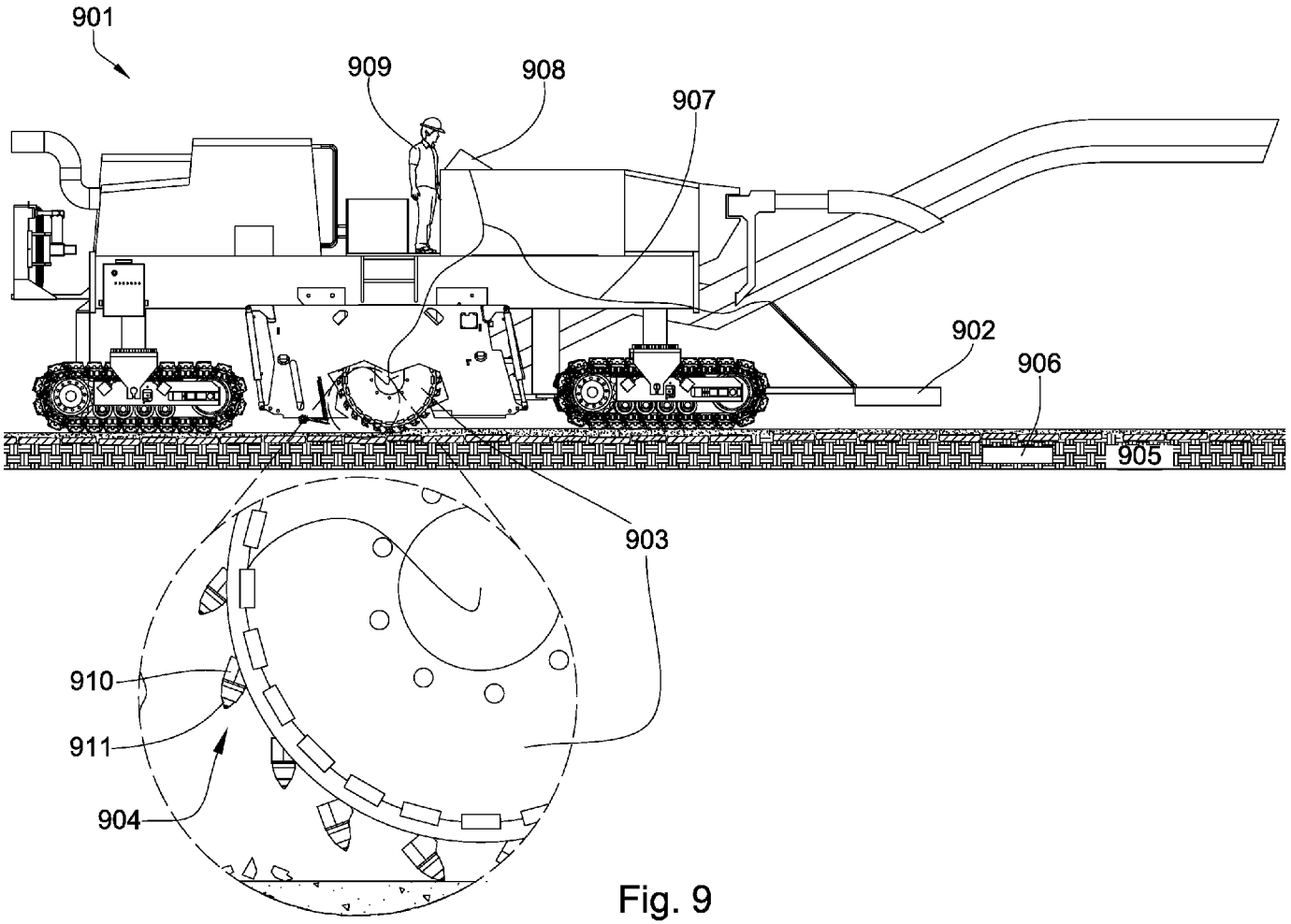
FIG. 9 is an orthogonal view of an embodiment of a pavement milling machine.

FIG. 9 discloses an embodiment of a pavement milling machine 901 comprising an object detection system 902. Also discloses is a magnified view of a rotatable drum 903 comprising a plurality of pick assemblies 904 wherein each pick assembly 904 comprises at least one block 910, a pick 911, and a piston cylinder device. The object detection system 902 may pass over a formation 905 and detect at least one object 906 buried underneath or located on the surface of the formation 905. An electrical signal comprising information, such as location and/or depth of the at least one object 906, may be sent through a wire 907 to an information processor 908 or sent directly to the pick assemblies 904. The drum 903 may pass over the formation 905 and the piston cylinder device may retract the pick 911 or the at least one block 910 to avoid making contact with the detected at least one object 906.

The object detection system 902 may comprise ground penetrating radar to detect hard materials buried underneath or located on the surface of the formation 905. It is believed that many hard materials, such as a man-hole cover, may comprise ferrous objects. The object detection system 902 may comprise a metal detector to detect specifically those hard materials comprising ferrous objects.

Upon detecting the at least one object 906, the electrical signal may be sent directly to the pick assemblies 904 such that the piston cylinder devices will retract automatically to avoid making contact with the detected at least one object 906. The electrical signal may be sent to the information processor 908. An operator 909 may manually control the axial position of each pick 911 in the pick assemblies 904 using the information processor 908 such that the operator 909 may retract the piston cylinder devices to avoid making contact with the detected at least one object 906.

An electrical signal comprising stored information about the at least one object 906 may be sent to the pick assemblies 904. The electrical signal may instruct the piston cylinder devices to retract to avoid making contact with the at least one object 906. The stored information may come from a previous survey of the formation 905, from the operator 909, or another source.

Figure 10:
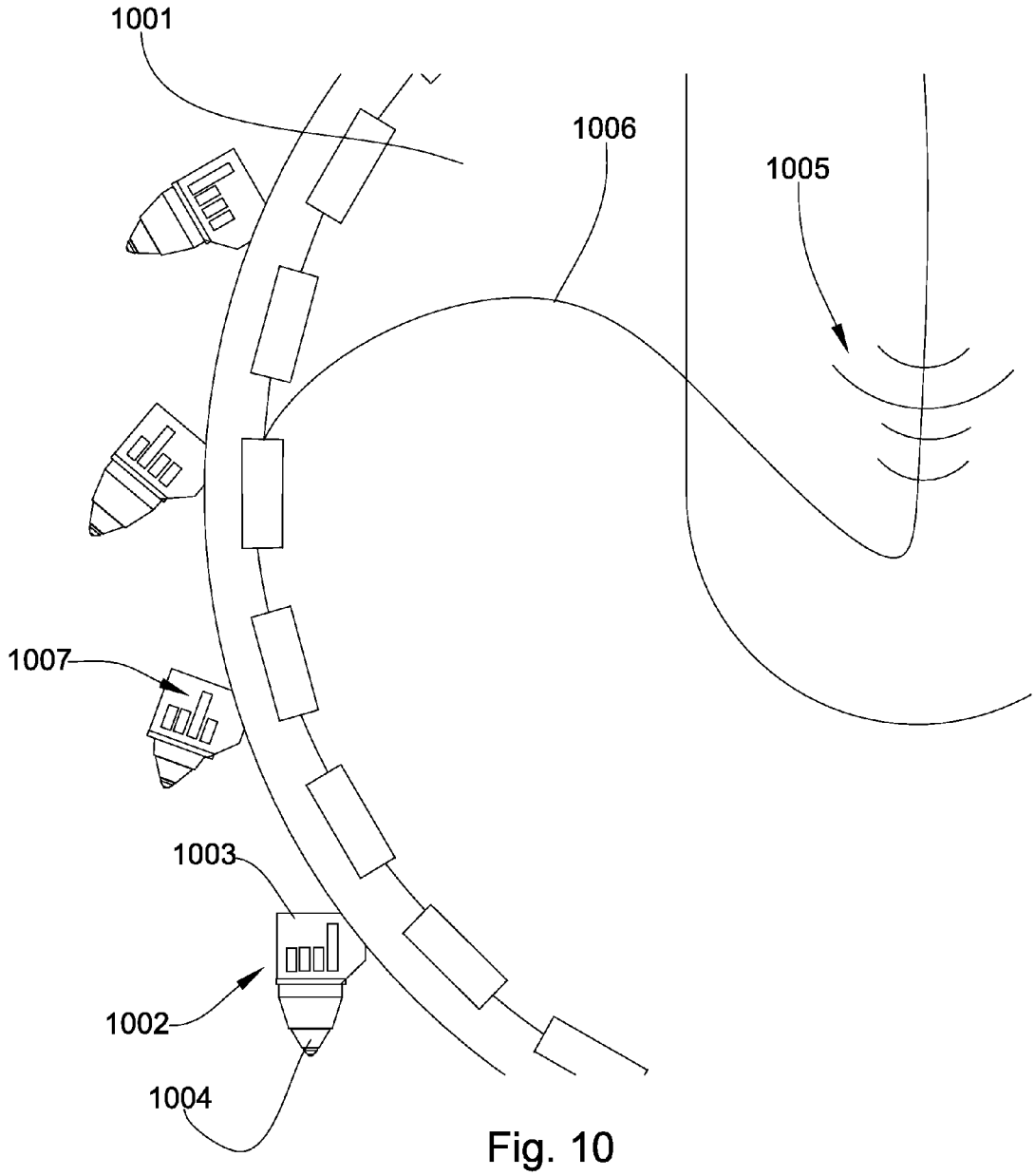
FIG. 10 is a cross-sectional view of an embodiment of a rotatable drum.

FIG. 10 discloses an embodiment of a rotatable drum 1001 comprising a plurality of pick assemblies 1002. Each pick assembly 1002 may comprise at least one block 1003 disposed on a circumferential surface of the drum 1001, a pick 1004 disposed within each block, and a piston cylinder device within the at least one block 1003 or pick 1004. Each piston cylinder device may be capable of expanding or retracting the at least one block 1003 or pick 1004 and may comprise a unique identifier signal receiver 1007. An electrical signal may send an identifier signal 1005 which is recognized by a specific piston cylinder device. Identifier signals 1005 may instruct piston cylinder devices to expand and retract independently of each other. In the embodiment shown, the identifier signal 1005 comprises two short pulses, a long pulse and then a short pulse which may be identified by a unique piston cylinder device as the signal to retract.

Figure 11:
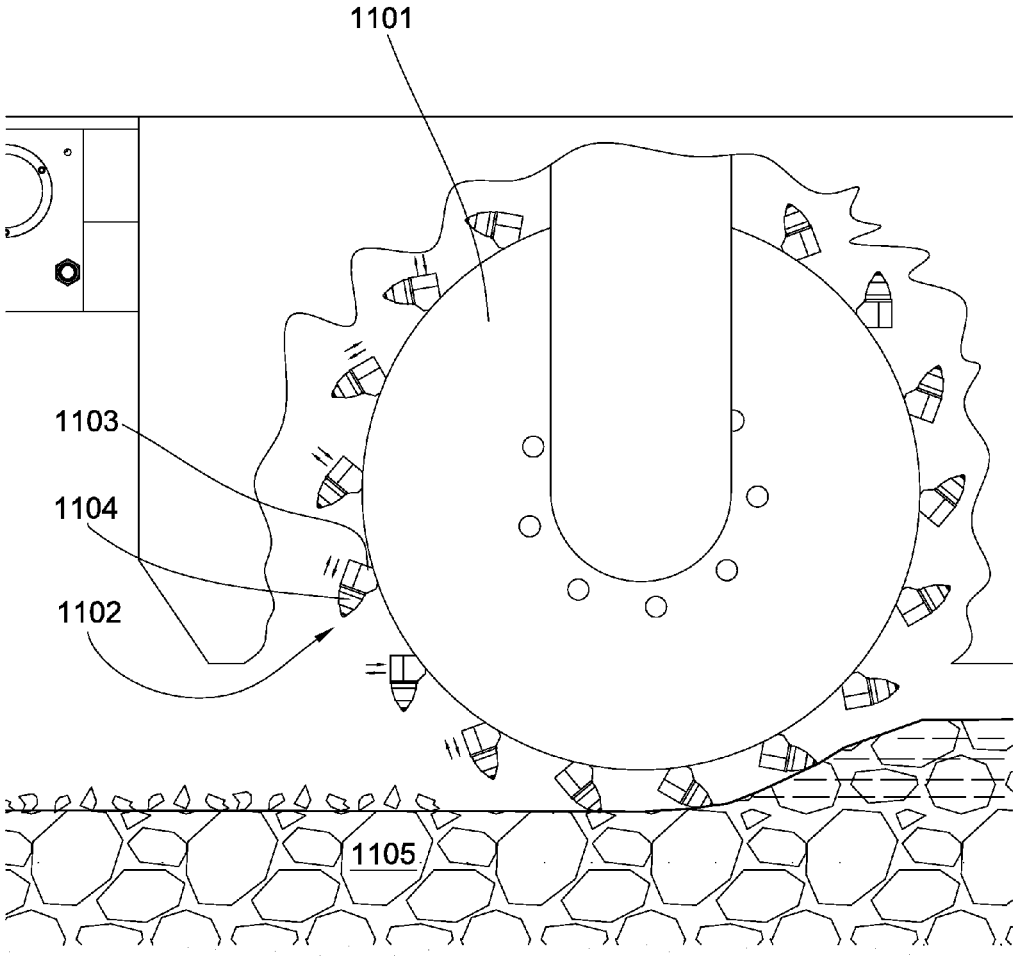
FIG. 11 is an orthogonal view of an embodiment of a rotatable drum.

FIG. 11 discloses an embodiment of a rotatable drum 1101 comprising a plurality of pick assemblies 1102 wherein each pick assembly 1102 may comprise at least one block 1103, a pick 1104, and a piston cylinder device within the at least one block 1103 or pick 1104. The drum 1101 may pass over and remove a portion of a formation 1105 with the pick 1104. The piston cylinder device may be capable of expanding or retracting the at least one block 1103 or pick 1104 to vary the volume of the formation 1105 removed.

Whereas the present invention has been described in particular relation to the drawings attached hereto, it should be understood that other and further modifications apart from those shown or suggested herein, may be made within the scope and spirit of the present invention.

What is claimed is:

1. A pick assembly, comprising:

a rotatable drum comprising at least one block disposed on a circumferential surface of the drum;

the at least one block comprising a cavity comprising a cylinder;

a pick comprising a working end and an opposing base end wherein the base end is disposed within the cavity;

the base end comprising a piston that is slidably retained within the cylinder; and wherein the piston defines first and second pressure chambers within the cylinder.

2. The pick assembly of claim 1, further comprising a first fluid channel in fluid communication with the first pressure chamber and a second fluid channel in fluid communication with the second pressure chamber.

3. The pick assembly of claim 2, further comprising a pressurized fluid channel, a relief fluid channel, and at least one valve alternately connecting the first and second fluid channels to the pressurized fluid channel and the relief fluid channel.

4. The pick assembly of claim 3, wherein the pick comprises an expanded axial position when the pressurized fluid channel is in fluid communication with the second fluid channel and a retracted axial position when the pressurized fluid channel is in fluid communication with the first fluid channel.

5. The pick assembly of claim 3, wherein the at least one valve is controlled by a mechanical actuator comprising a linear solenoid, a rotary solenoid, or a hydraulic motor.

6. The pick assembly of claim 5, wherein the mechanical actuator is in communication with an electronic circuit which reads data, redirects power, and sends information about the position of the at least one valve through an armored coaxial wire.

7. The pick assembly of claim 6, wherein the rotatable drum comprises a plurality of blocks disposed on a circumferential surface of the drum, each block is connected to a unique electronic circuit, and a single armored coaxial wire connects all unique electronic circuits.

8. The pick assembly of claim 2, further comprising a pressurized fluid channel, a relief fluid channel, and at least one valve alternately connecting the second fluid channel to the pressurized fluid channel and the relief fluid channel while the first fluid channel is connected to the pressurized fluid channel; wherein the first pressure chamber comprises a first surface and the second pressure chamber comprises a second surface wherein the second surface is substantially greater than the first surface; and wherein pressure in the second pressure chamber expands the pick when the second fluid channel is connected to the pressurized fluid channel.

9. A pick assembly, comprising:

a rotatable drum comprising at least one block disposed on a circumferential surface of the drum;

the rotatable drum comprising a cavity comprising a cylinder;

the at least one block comprising a first end and an opposing second end wherein the second end is disposed within the cavity;

a pick comprising a working end is rigidly secured to the first end of the at least one block; and the second end comprising a piston that is slidably retained within the cylinder.

10. A method of milling a surface with a pick assembly, comprising:

providing a rotatable drum, a plurality of blocks disposed on a circumferential surface of the drum, and at least one pick disposed within each block;

providing a piston cylinder device within each block or each pick capable of expanding or retracting each block or each pick independently; and sending an electrical signal through a single armored coaxial wire to independent piston cylinder devices instructing the piston cylinder devices to expand or retract independently.

11. The method of claim 10, wherein each piston cylinder device comprises a unique identifier signal and the piston cylinder device recognizes the identifier signal when it is sent through the single armored coaxial wire.

12. The method of claim 10, further comprising:

providing an object detection system;

passing the object detection system over a surface;

detecting at least one object on or beneath the surface with the object detection system;

wherein the sending the electrical signal comprises transmitting information about the detected at least one object;

passing the rotatable drum over the surface; and retracting the piston cylinder device to avoid making contact with the detected at least one object.

13. The method of claim 12, wherein the object detection system comprises ground penetrating radar.

14. The method of claim 12, wherein the object detection system comprises a metal detector.

15. The method of claim 12, wherein the retracting the piston cylinder device to avoid making contact with the detected at least one object comprises retracting the piston cylinder device automatically.

16. The method of claim 12, wherein the retracting the piston cylinder device to avoid making contact with the detected at least one object comprises retracting the piston cylinder device manually.

17. The method of claim 10, further comprising:

passing the rotatable drum over a surface;

removing a portion of the surface with the at least one pick; and varying a volume of the portion removed by expanding or retracting the piston cylinder device.

18. The method of claim 10, further comprising:

wherein the sending the electrical signal comprises transmitting stored information about at least one object on or beneath a surface;

passing the rotatable drum over the surface; and retracting the piston cylinder device to avoid making contact with the at least one object.

* * * * *